US007247822B2

(12) United States Patent
Johnston

(10) Patent No.: US 7,247,822 B2
(45) Date of Patent: Jul. 24, 2007

(54) CARBON FIBER HEATING ELEMENT ASSEMBLY AND METHODS FOR MAKING

(75) Inventor: James J. Johnston, St. Petersburg, FL (US)

(73) Assignee: Methode Electronics, Inc., Chicago, IL (US)

( * ) Notice: Subject to any disclaimer, the term of this patent is extended or adjusted under 35 U.S.C. 154(b) by 99 days.

(21) Appl. No.: 10/772,641

(22) Filed: Feb. 5, 2004

(65) Prior Publication Data

US 2005/0184051 A1 Aug. 25, 2005

(51) Int. Cl.
*H05B 3/34* (2006.01)

(52) U.S. Cl. ..... 219/549; 219/213; 392/435

(58) Field of Classification Search ..... 219/213, 219/528, 529, 542, 546, 548, 549, 544, 550, 219/203; 392/432, 435; 338/210, 212, 254, 338/255, 306; 343/702
See application file for complete search history.

(56) References Cited

U.S. PATENT DOCUMENTS 3,657,516 A * 4/1972 Fujihara ..... 392/435
4,733,059 A * 3/1988 Goss et al. ..... 219/548
4,761,541 A * 8/1988 Batliwalla et al. ..... 219/528
4,817,347 A * 4/1989 Hand et al. ..... 52/171.3
6,026,563 A 2/2000 Schilson
6,045,906 A * 4/2000 McMahon et al. ..... 428/364
6,452,138 B1 * 9/2002 Kochman et al. ..... 219/549
6,541,744 B2 * 4/2003 Von Arx et al. ..... 219/544
6,610,773 B1 * 8/2003 Sundararaj et al. ..... 524/449
6,639,562 B2 * 10/2003 Suganthan et al. ..... 343/702
6,737,586 B2 * 5/2004 Inagaki et al. ..... 174/110 R
2004/0035854 A1 * 2/2004 Cheng et al. ..... 219/549

* cited by examiner

*Primary Examiner*—Thor S. Campbell
(74) *Attorney, Agent, or Firm*—McCormick, Paulding & Huber LLP

(57) ABSTRACT

An electrical resistance heating element has an axially elongated flat carbon fiber tow, which includes a multiplicity of continuous axially parallel carbon filaments. The tow is sandwiched between two layers of polyester sheet material and bonded to only one of the layers. The other of the layers overlies the tow in direct contacting engagement with and unconnected relation to the tow and is connected to longitudinally extending marginal portions of the one layer along transversely opposite sides of the tow. The heating element may be produced by a continuous forming process.

36 Claims, 6 Drawing Sheets

CARBON FIBER HEATING ELEMENT ASSEMBLY AND METHODS FOR MAKING

FIELD OF THE INVENTION

This invention relates in general to heating element assemblies and deals more particularly with improvements in non-metallic heating element assemblies of electrical resistance type.

BACKGROUND OF THE INVENTION

The present invention is particularly concerned with improvements in non-metallic heating element assemblies and particularly electrically conductive carbon fiber heating element assemblies suitable for general purpose usage in a wide variety of heating applications.

The development of improved processes for artificially producing staple carbon in fibrous or filamentary form and at reasonable cost has virtually revolutionized the plastic composite industry, particularly where light weight and a high degree of mechanical integrity is desired. New materials embodying carbon in fibrous or filamentary form now enjoy wide spread use in the production of golf shafts, aircraft parts, and indeed entire airframes, to cite a few outstanding examples. Advantages in the use of carbon in the electrical field were early recognized by pioneers in that field, and although artificially produced carbon fiber has found some limited usage in electrically operated heating device, the potential for such usage has not yet been fully realized.

Accordingly, it is the general aim of the present invention to provide improved electrical heating element assemblies employing carbon fiber technology and suitable for supplying heat in a wide variety of environments both small and large. It is a further aim of the present invention to provide improved carbon fiber heating element assemblies for use in a variety of automotive heating applications as, for example, warming the seats and steering wheel of a vehicle, deicing and defogging windows, outside rear view mirrors and various vehicle engine heating applications.

A still further aim of the invention is to provide improved carbon fiber heating elements for economic installation and operation to heat large surface areas such as the floors of up-scale homes, apartments and condominiums, the surfaces of parking lots, sidewalks, driveways, highway sections, bridge decks and airport runways, as well as the surfaces of aircraft which operate thereon.

Yet another aim of the invention is to provide carbon fiber heating element assemblies, which utilizes to advantage the negative coefficient of electrical resistance (ohm) exhibited by carbon fiber.

SUMMARY OF THE INVENTION

In accordance with the present invention, a heating element assembly comprises an axially elongated longitudinally extending generally flat bundle of substantially rectilinear continuous carbon fibers or filaments of indeterminate axial length. The bundle has a predetermined electrical resistance per unit of axial length and is disposed between generally flat layers of dielectric sheet material arranged in opposing face-to-face relation to each other with one of the layers in direct overlying contacting engagement with and unconnected relation to an associated flat surface of the bundle and the other of the layers adhered to another flat surface of the bundle opposite the associated flat surface.

Marginal portions of the layers are connected to each other along the entire axial length of the bundle and immediately adjacent longitudinally extending transversely opposite sides of the bundle, whereby a sheath formed by the layers is sealed against axially transverse migration of moisture through the sheath. The sheath also serves to electrically insulate the bundle.

DETAILED DESCRIPTION OF THE PREFERRED EMBODIMENTS

Figure 1:
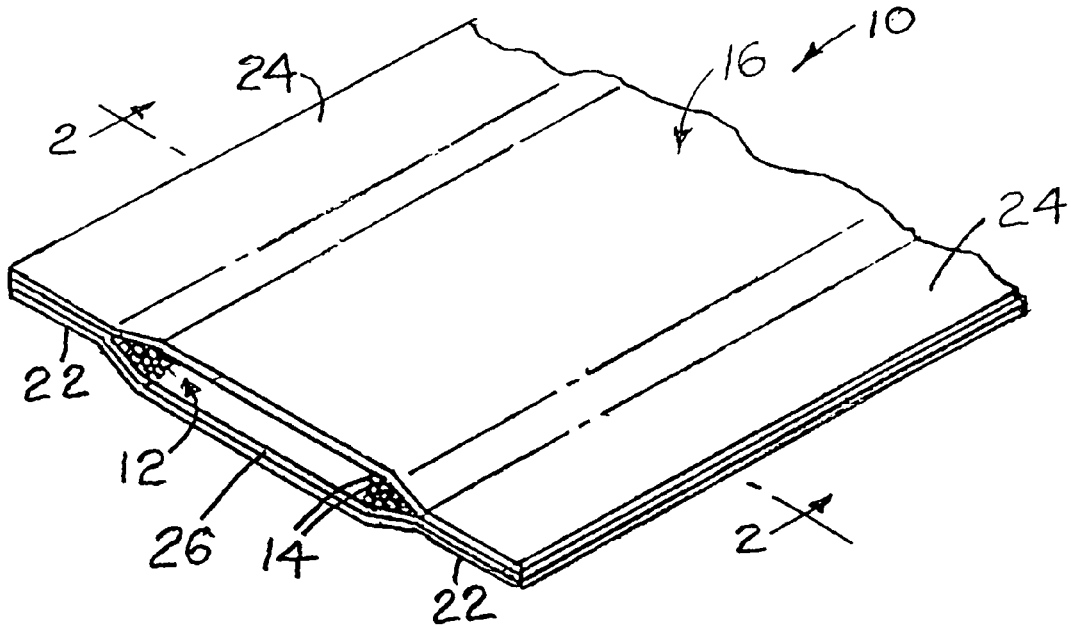
FIG. 1 is a fragmentary perspective view of a heating element assembly embodying the present invention.
Figure 2:
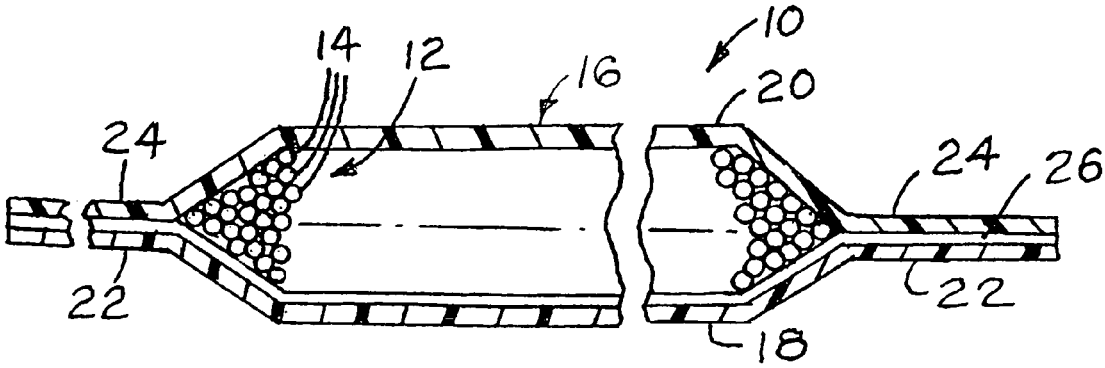
FIG. 2 is a somewhat enlarged sectional view taken along the lines 2—2 of FIG. 1.

Turning now to the drawings and referring first particularly to FIGS. 1 and 2, a typical heating element assembly embodying the present invention and made in accordance with the invention is indicated generally by the reference numeral 10. In the description which follows and in the claims directional terms such as upper and lower are employed for convenience and refer to the illustrated heating element assembly 10 as oriented in the drawings, however, it should be understood that the heating element assembly of the present invention may be operated in any orientation.

The illustrated heating element assembly 10 essentially comprises an axially elongated substantially flat bundle of individual continuous carbon fibers or filaments, which cooperate to form an electrical heating element which transforms electrical energy applied thereto into heat energy, the flat bundle or heating element being designated generally by the reference numeral 12 and that individual fibers or filaments being indicated at 14, 14. The assembly 10 further includes an outer jacket or electrically insulating sheath, indicated generally at 6, formed by lower and upper layers of relative thin dielectric sheet material 18 and 20, respectively. The layers 18 and 20 are of equal width and thickness, and arranged in opposing face-to-face relation to each other with the heating element 21 disposed therebetween. The upper face of the lower layer 18 is boded to the lower surface of the bundle 12, whereas the lower face of the upper layer 20 is disposed in direct contacting engagement with an in unconnected relation to the associated upper surface if the flat bundle 12, which it directly overlies and compliments.

Longitudinally extending marginal portions of the layers 18 and 20, indicated at 22, 22 and 24, 24, respectively, project outwardly in opposite axially transverse directions for some distances beyond the longitudinally extending opposite sides of the bundle 12 and are joined in face-to-face relation to each other by appropriate connecting and sealing means along each side of the bundle and along substantially the entire axial length of the bundle 12 for preventing migration of moisture transversely through the sheath 16 formed by the connected layers 18 and 20. The connected lower and upper marginal portions 22, 22 and 24, 24, respectively, may also serve as mounting flanges for securing the heating element assembly 10 in an operating position relative to associated product or structure to be heated. In the illustrated embodiment 10 the connecting and sealing means comprise a coating of pressure sensitive adhesive, indicated at 26, best shown in FIG. 2, and initially applied to and carried by the lower layer 18.

In accordance with presently preferred construction, both the carbon filaments 14, 14, which comprise the heating element or bundle 12, and the layers of dielectric sheet material from which the outer sheath 16 is formed are flexible so that the heating element assembly 10 may be produced in indeterminate length for storage on a dispensing reel or the like and to facilitate flexure during mounting and/or when in use, if necessary. Ultimately, the length of the heating element assembly 10 will be determined by the particular requirements of the product or structure in which it is utilized.

Considering now the heating element assembly 10 in further detail, in accordance with presently preferred construction, the bundle 12 comprises a generally flat carbon fiber tow having a multiplicity of artificially produced carbon fibers or filaments 14, 14 and a thickness to width ratio of about 1 to 25. The tow may be made from polyacrylonitrile (PAN) or other suitable polymer precursor by a pyrolizing process, as is well known in the carbon fiber art. The terms carbon fiber tow and carbon filament tow as used herein, and in the claims, refer to a loose, untwisted, rope-like flat bundle of continuous generally rectilinear parallel carbon fibers extending in an axial direction (i.e. slender and greatly elongated axially extended filaments) which may include from several hundred individual continuous generally rectilinear flexible filaments 14, 14 to several tens of thousands of such filaments and having an electrical resistance in the range from 0.1 to 20 ohms per linear foot. However, in accordance with present practice, a tow having from 1 thousand to 50 thousand generally cylindrical filaments or fibers 14, 14 each having a diameter ranging from 6 to 10 microns and an electrical resistance (cold) in the range of 2 to 3 ohms per linear foot, plus or minus 0.10 ohm, is used in practicing the invention, a tow having 50,000 filaments of 7 micron diameter being presently preferred.

A commercial grade carbon fiber tow, that is a tow which is 94–96 percent pure carbon by weight may be employed in practicing the invention. A tow of military grade may also be employed. However, a tow of the later type, which is 98 percent pure carbon by weight, is considerably more expensive to produce and, for this reason, a commercial grade material is presently preferred and should result in a heating element suitable for most heating applications.

The outer jacket or insulating sheath 16 may be made from any suitable flexible dielectric plastic material. However, since the heating element assembly 10 is designed to operate within a temperature range from approximately minus 100° F. to 250° F., the dielectric material chosen for use in making the sheath 16 must be capable of withstanding temperatures within the aforesaid anticipated operating range without undergoing an appreciable change in physical characteristics or a significant increase in its rate of deterioration. The flexible sheath material should also possess the required characteristic which allow it to be bonded to itself or to another material either by a suitable adhesive or by a non-adhesive bonding process which provides a moisture-tight seal of substantial integrity in the region of joinder. As previously noted, a relatively thin plastic sheet material is used in making the heating element jacket 16, MYLAR, a thermoplastic polyester, being a presently preferred material. The sheath may also be made from a polyimide, KAPTON being a preferred material where a sheath of thermosetting material may be desired.

The entire jacket or sheath 16 may be made from the same material as, for example, polyester sheet or web material having a thickness of two mil (0.0002 inch) (0.0508 millimeter). However, the upper layer 20 is the preferred heat transfer medium because it is in direct contact with the heating element 12, unlike the lower layer 18 which is or may be separated from the heating element by a layer of adhesive which provides some degree of heat insulation. Since the upper and lower surfaces of the heating element assembly 10 have differing heat transfer characteristics, the assembly is preferably coded to enable one layer to be readily distinguished from the other. A color coding is presently preferred wherein the layers are of differing colors to assure proper mounting and provide the most efficient heat transfer to an associated surface or structure to be heated.

Figure 3:
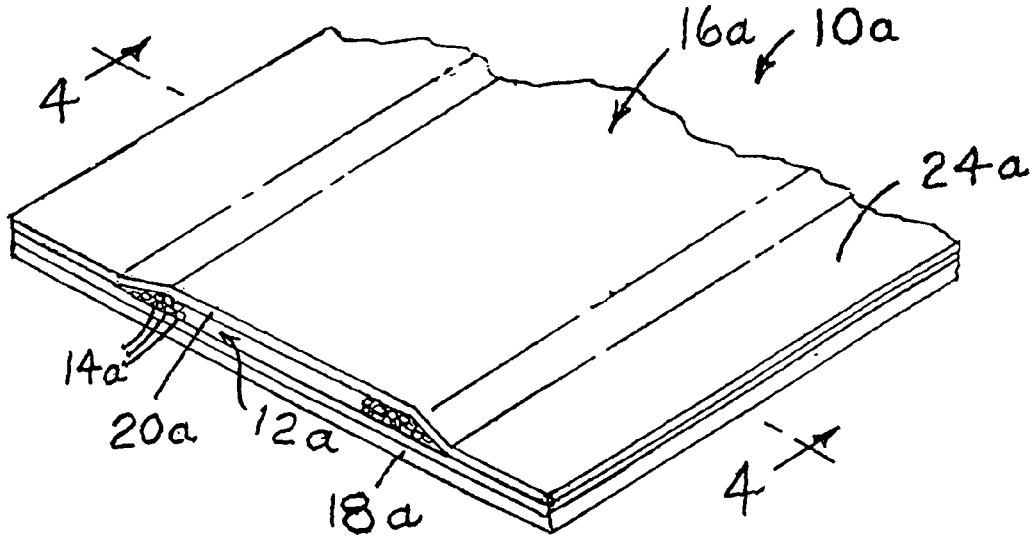
FIG. 3 is a fragmentary perspective view showing another embodiment of the invention.
Figure 4:
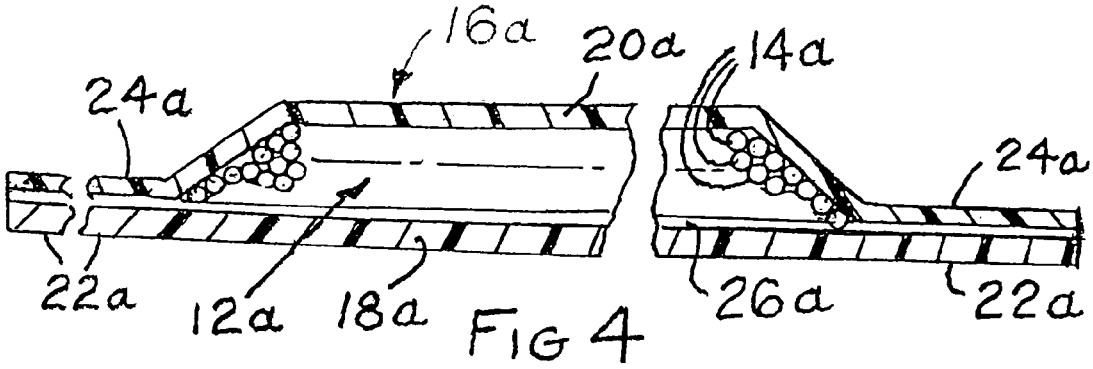
FIG. 4 is a somewhat enlarged sectional view taken along the lines 4—4 of FIG. 3.

In FIGS. 3 and 4 there is shown another heating element assembly embodying the invention and indicated generally at 10*a*. Parts of the assembly 10*a* which correspond to parts of the previously described assembly 10 bear the same numerals as the previously described parts with a letter "a" suffix and will not be further described in detail.

The assembly 10*a* differs from the assembly 10 in that it has a generally flat planar lower layer 18*a*, which is substantially thicker than the upper layer 20*a*. It will also be noted that the upper layer 20*a* is made from a web of material substantially wider than the web from which the lower layer 18*a* is made. The lower layer 18*a*, that is the layer which is connected to and stabilizes the tow 12*a*, has a thickness somewhat greater than the thickness of the upper layer or unconnected layer 20*a*, which preferably comprises the heat transfer medium. Thus, in accordance with a presently preferred construction, the lower layer may, for example, have a thickness of two mil (0.0002 inch) (0.0508 mm) whereas the thickness of the upper layer 20 may be 1 mil (0.0001 inch) (0.0254 mm).

Figure 5:
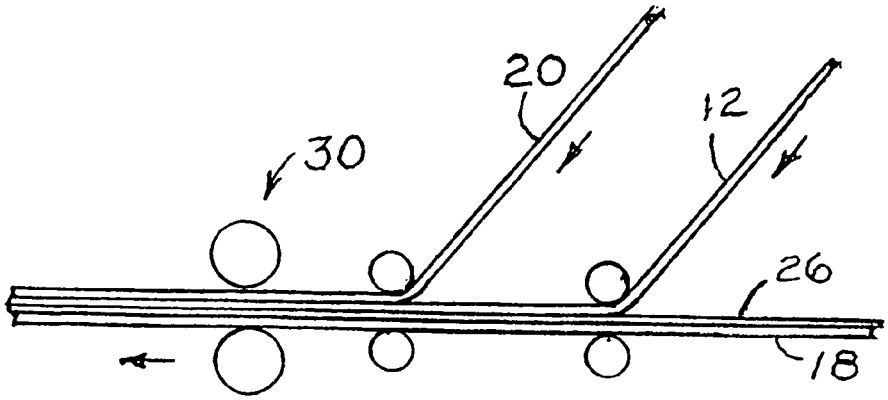
FIG. 5 is a somewhat schematic side elevational view illustrating a method of making a heating element assembly in accordance with the present invention.

The heating element assembly of the present invention, exemplified by the assembly 10, is preferably produced by a continuous forming process shown somewhat schematically in FIG. 5 wherein the tow 12, which has been preferably previously produced with a flattened cross section configuration, is moisturized and continuously advanced and guided by a set of guide rolls or other suitable guiding means into alignment and overlying engagement with the upper face of a continuously advancing lower layer or web of polyester sheet material 18, the entire upper face of which is precoated with a pressure sensitive adhesive 26. A continuously advancing second web or upper layer of sheet material 20 is simultaneously guided and fed into overlying engagement with the advancing tow 12 and the advancing first layer 18 which underlies the tow. The advancing subassembly, which includes the tow 12, the adhesive coated lower layer 18 and the uncoated upper layer 20, passes between a set of pressure rollers, indicated generally at 30, which generally compliment the cross-sectional configuration of the aforesaid subassembly. The pressure rollers press the marginal portions 24, 24 of the uncoated upper layer 20 into adhering engagement with complimentary marginal portions 22, 22 of the pressure sensitive adhesive coated lower layer 18. Pressure is simultaneously applied to the central portion of the subassembly to adhere the lower surface of the flattened tow 12 to the adhesive coated upper face of the lower layer 18 whereby to complete formation of the advancing sheath 16, which then embraces the simultaneously advancing flattened tow 12.

A similar forming process may be employed using a heat-activated adhesive preapplied to the first or lower layer, for example. The adhesive may be activated by heated pressure rolls or other suitable heating mean during the sheath forming process. If a heat-activated adhesive is employed, an additional curing or drying cycle may be included in the process to complete assembly of the sheath 16. Once activated the heat activated adhesive takes a permanent set and remains substantially unchanged even after application of additional heat.

Various other bonding processes may be employed to join and seal the marginal portions of the upper layer 20 to associated marginal portions of the lower layer 18 and/or to connect the tow 12 to the lower layer 18. Thus, for example, the marginal portions may be joined by an ultrasonic welding process or the simultaneous application of heat and pressure as, for example, where the marginal portions are passed between heated rollers or the like. However, any process employed to attach the upper face of the lower layer to the lower surface of the tow must be capable of effecting attachment without destroying or otherwise damaging the electrical continuity of the elongated fibers or filaments which comprise the tow.

Figure 6:
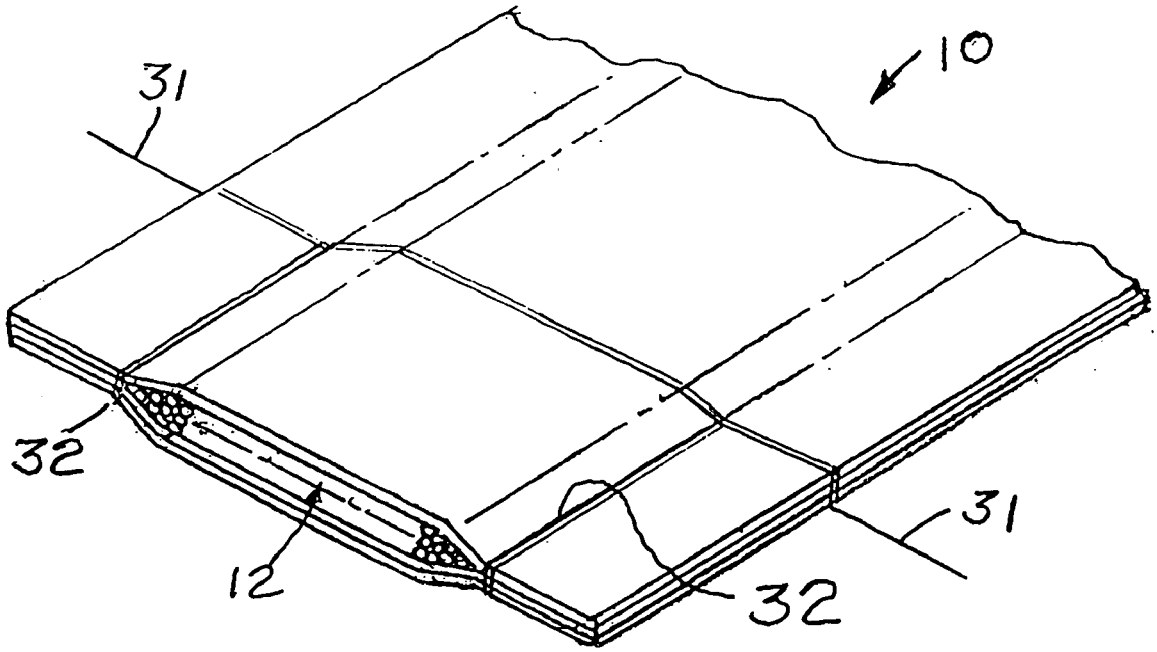
FIG. 6 is a fragmentary schematic perspective view and illustrates a method for stripping an end portion of the heating element assembly of FIGS. 1 and 2.
Figure 7:
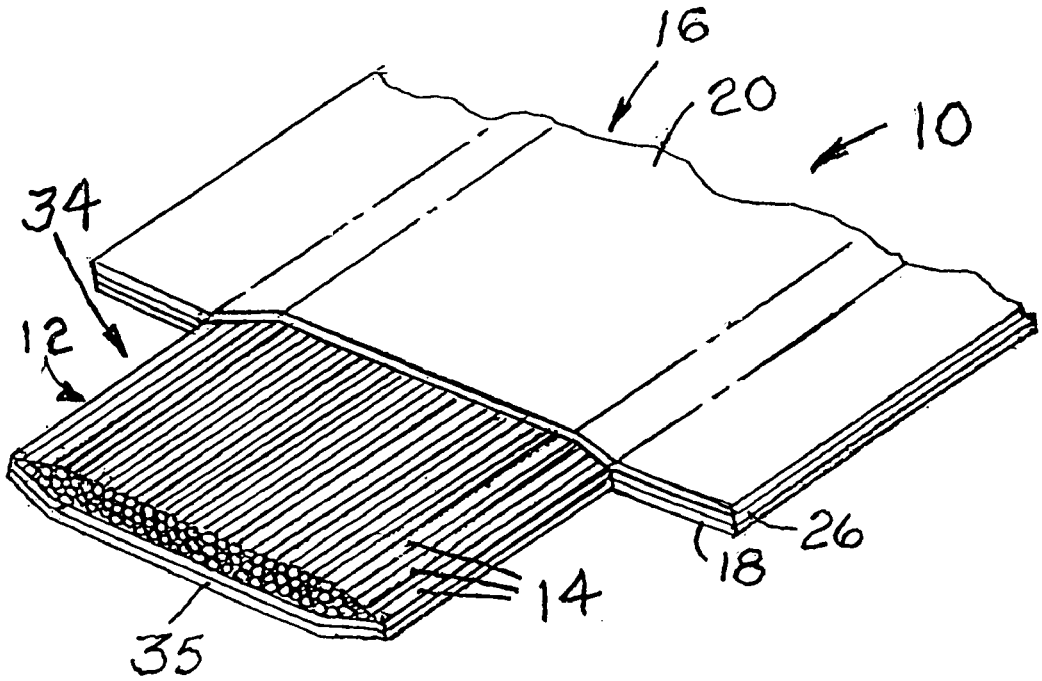
FIG. 7 is a fragmentary perspective view of the stripped end portion of the heating element assembly of FIG. 6.

As previously noted, the length of a heating element assembly will be determined by the particular heating requirements of the product or structure in which it is to be employed. When the required axial length of the heating element assembly has been determined, opposite end portions of the heating element 12 are prepared for electrical termination. More specifically, and with further reference to the assembly 10, a portion of the outer jacket or sheath 16 is removed from each end portion of the heating element assembly 10 to prepare the heating element 12 for electrical termination, that is to facilitate electrical connection to an electrical power source (not shown). Each end portion of the completed heating element assembly 10 is prepared for electrical termination by stripping from the assembly 10 an end portion of the upper layer 20 which overlies the tow 12 and associated marginal end portions 22, 22 and 24, 24 of the upper and lower layers which extent transversely outwardly beyond the tow. Stripping is best accomplished using an electrically heated nickel chromium wire under tension, shown at 31 in FIG. 6. The heated wire 31 is pressed downwardly on the assembly 10 to cut entirely through both upper and marginal portions and through the upper layer 20 down to the upper surface of the tow 12. Since the melting temperature of the sheath 16 is much lower than that of the carbon fiber tow 12, the hot wire stripping operation may be preformed without risk of damaging the tow. Secondary slits, indicated at 32, 32 in FIG. 6, are cut or otherwise formed at opposite sides of the tow 12 and in parallel relation to the direction axial extent of the tow whereby the central end portion of the upper layer 20 and the entire associated marginal end portions formed by the joinder of the lower and upper layers are removed. The resulting stripped terminal end portion of the heating element assembly 10, indicated generally at 34 in FIG. 7, includes an end portion of the tow 12 which extends outwardly beyond the end of the upper layer 20 and an extending tab 35 formed by a portion of the lower layer 18. The tab 35 underlies the extending terminal end portion 34 and is adhered to the lower surface of the terminal end portion. Thus, the bare upper surface of the tow end portion 34 is exposed beyond the cut end of the upper layer 20 to facilitate electrical termination, whereas the extending lower portion or tab 34 on the lower layer 18 remains connected to the lower surface of the tow to stabilize the tow terminal end portion 34. Thus, the relatively fine, delicate exposed end portion of the tow 12 derives support from the extending tab 35 on the lower layer 20 which is adhered to filaments at 14, 14 at the lower surface of the tow so that the resulting exposed terminal end portion 34 can be conveniently handled during a later electrical termination process without substantial risk of damage to the tow.

Figure 8:
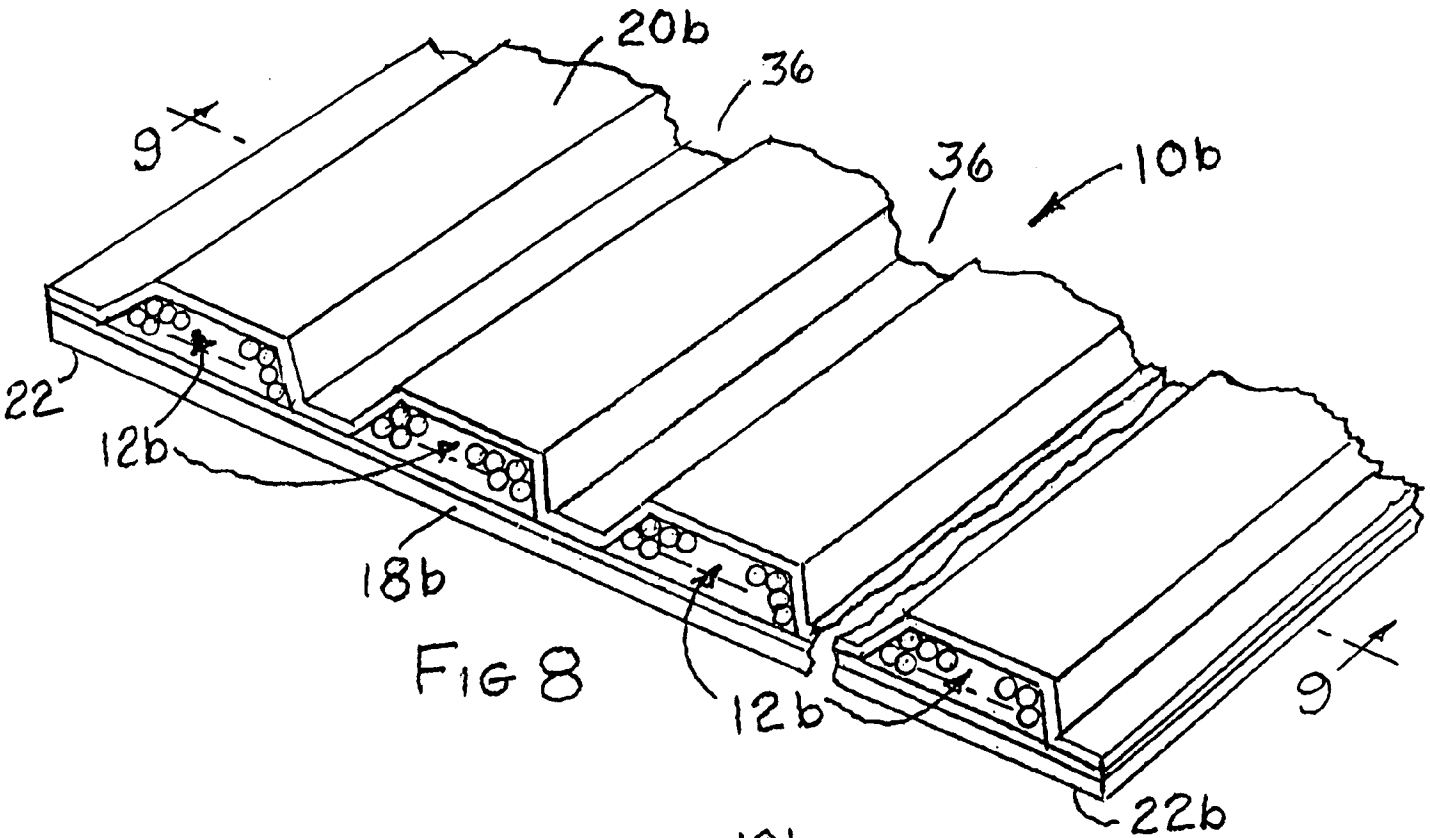
FIG. 8 is a fragmentary perspective view of a further heating element assembly made in accordance with the invention.
Figure 9:
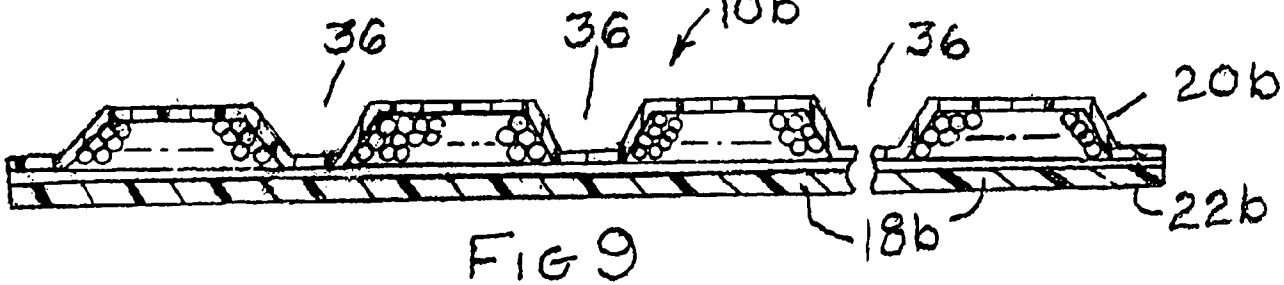
FIG. 9 is a somewhat enlarged fragmentary sectional view taken along the line 9—9 of FIG. 8.

Further referring to the drawings and particularly FIGS. 8 and 9, another heating element assembly embodying the present invention is indicated generally at **10*b*. The illustrated heating element assembly 10*b* essentially comprises a series of axially elongated, axially parallel flexible carbon fiber tows 12*b*, 12*b* of undetermined axial length. The tows may vary in number and are spaced apart and have interstacies 36, 36, therebetween. Each tow 12*b* has a multiplicity of continuous axially parallel carbon filaments 14*b*, 14*b* disposed in immediate adjacent relation to each other and a predetermined electrical resistance per unit of tow length. The tows 12*b*, 12*b* are sandwiched between opposing first and second layers of polyester sheet material, preferably MYLAR, indicated at 18*b* and 20*b*, respectively. The layers 18*b* and 20*b* are bonded together in face-to-face relation to each other along the interstacies 36, 36 and along longitudinally extending marginal portions 22*b*, 22*b*, located outboard of the outermost tows in the series to form a dielectric outer jacket 16b. The marginal bonds between the layers 18*b* and 20*b* have a high degree of sealing integrity to prevent transverse migration of moisture into the jacket 16b through the marginal portions thereof and between the tows within the jacket 16b. The face of one of the layers 18*b* and 20*b* is bonded to associated surfaces of the tows 12*b*, 12*b* to stabilize the tows as hereinbefore discussed. The other of the layers is disposed in direct contacting engagement with the tows 12*b*, 12*b*, but is not connected to the tows, which allows the assembly 10*b* to be cut to desired length at any point along its entire length. The resulting end portion may be stripped at that time or at a later time for electrical termination, as hereinbefore discussed. The unconnected layer preferably serves as a heat transfer medium when the heating element assembly 10*b*** is mounted in a device or structure to be heated.

Heating element assemblies in accordance with the invention are adapted to operate within a temperature range, which utilizes to advantage the negative temperature coefficient characteristic of carbon fiber. Thus, when a heating element assembly of the present invention is operated within such a temperature range, 150° F. to 200° F., for example, the electrical resistance of the heating element assembly decreases as the temperature of the heating element increases. The advantage attained by utilizing the aforesaid phenomenon will be better understood from a comparison of a typical carbon fiber heating element assembly and one of a conventional metal type.

Figure 10:
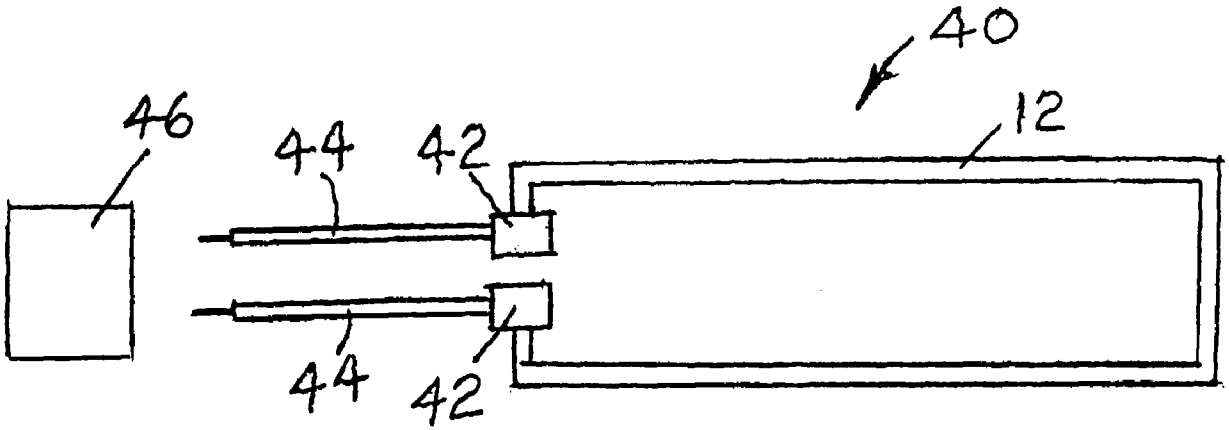
FIG. 10 is a diagrammatic view of an apparatus for determining the electrical resistance per unit of length of a typical heating element assembly embodying the present invention.

Referring now to FIG. 10, a test apparatus for determining the electrical resistance of the aforesaid heating element network at standard temperature and pressure is illustrated and indicated generally at 40. A carbon fiber tow or heating element 12 of the type used in making the heating element assembly 10 and having 50 thousand carbon fibers of seven micron diameter and a 10 foot length is electrically terminated at 42, 42 by lead conductors 44, 44 suitable for interconnection to electrical instrumentation. A four wire bridge type ohm meter 46 is used to measure the total resistance of the ten-foot network at standard temperature and pressure, whereby the resistance per foot of axial length is determined to be 2.8 ohms/ft.

Figure 11:
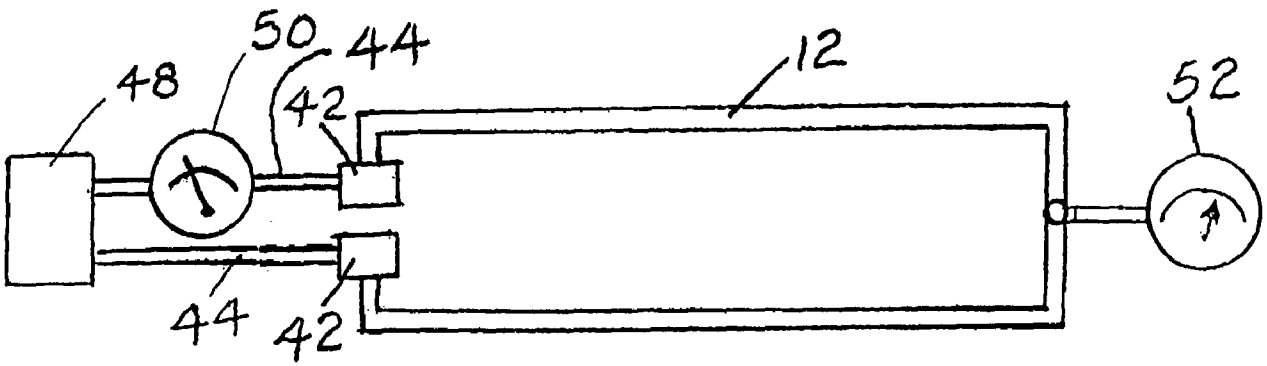
FIG. 11 is a diagrammatic view of an apparatus for determining the electrical resistance per unit of length of a test sample at various operating temperatures.

The aforedescribed network is then connected to another testing apparatus which includes a variable DC voltage source 48 (0–50 VDC), an amp meter 50 and a thermometer 52, as shown as in FIG. 11. The voltage is slowly adjusted until the temperature of the carbon fiber tow reaches 150° F. Thereafter, the voltage is increased to produce 10° F. increments of temperature increase until the temperature of the network reaches 200° F. The voltage (volts) and amperage (amps) for each 10° incremental increase in temperature is recorded. The electrical resistance for each 10° temperature increment is then calculated by applying ohm's law.

$$V = IR$$

Where $V$ = voltage (volts)

$I$ = current (amps)

$R$ = resistance (ohms)

$$R = \frac{V/I}{10'} = \text{ohms/ft}$$

Figure 12:
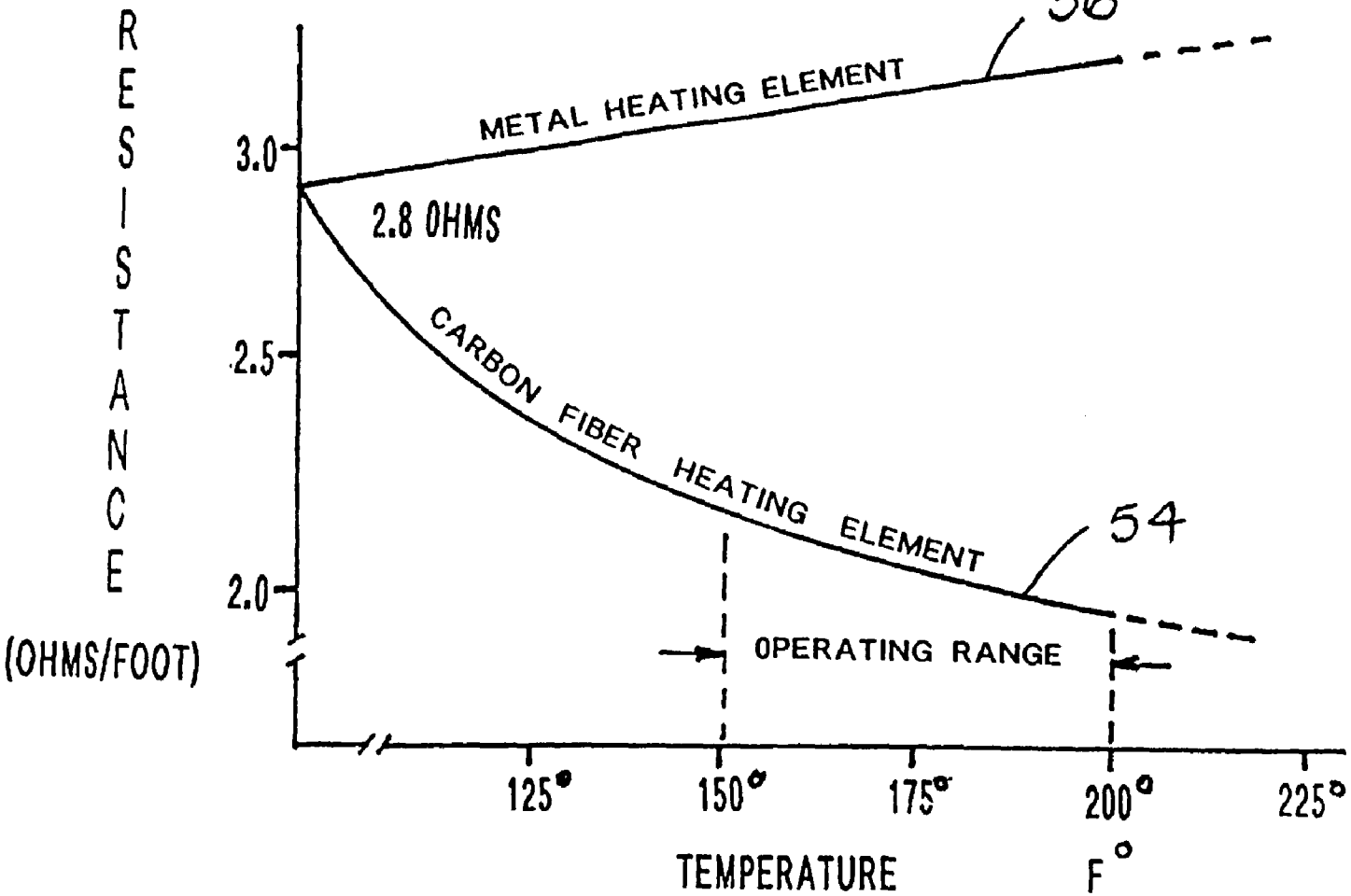
FIG. 12 is a graphic illustration of test results obtaining using the apparatus of FIG. 11.

A conventional metal heating element of 10 foot length is substituted for the carbon fiber network and the aforesaid test and calculations are repeated and the results are recorded for the metal heating element sample. The accumulated data is then used to plot the graphic illustration shown in FIG. 12. It will be noted that the resulting curve 54 for the carbon fiber heating element 12 has a negative slope throughout the anticipated operating range, which is characteristic of carbon fiber material, whereas the comparable curve 56 for a metallic heating element exhibits a positive slope throughout the entire anticipated operating range, indicating that electrical resistance increases as the temperature of the heating element material increases when operated within the range under consideration.

The aforesaid data will allow a designer to implement a carbon fiber heating element system to achieve a desired criteria. A typical heating application employing the aforesaid data developed for a heating element assembly 10 which has a 50 thousand (50K) carbon fiber tow and is designed to operate at 160° F. will now be considered.

Employing the data developed for a 50 K carbon fiber heating element assembly 10 where an element temperature of 160° F. is desired:

R @ standard temperature and pressure=2.8 ohms/ft.

R @ 160° F.=2.2 ohms/ft

I @ 160° F.=1.5 amps $V=IR$ $V=1.5\times2.2=3.3$ volts DC/ft

Applying the data developed for a metal heating element operating at 1.5 amps where R @ 160° F.=3 ohms/ft $V=1.5\times3=4.5$ volts/foot DC An increase in voltage input per foot of 1.2 volts or 27% is required by the metal heating element.

The development of similar data should enable a designer to implement a carbon fiber heating element assembly to achieve a desired criteria.

I claim:

1. A heating element assembly comprising; an electrical heating element including an axially elongated substantially flat bundle formed by a multiplicity of continuous axially extending carbon fibers which transforms electrical energy applied thereto into heat energy, said bundle having upper and lower surfaces including generally flat upper and lower surface portions substantially parallel to each other and a predetermined electrical resistance per unit of axial length, and a dielectric sheath embracing said bundle along its axial length, and including a lower layer having an upper face bonded to said lower surface of said bundle and an upper layer having a lower face disposed in overlying direct contacting engagement and unconnected relation to said upper surface of said bundle.

2. A heating element assembly as set forth in claim 1 wherein said bundle comprises from several hundreds to several tens of thousands of individual carbon fibers.

3. A heating element assembly as set forth in claim 1 wherein said bundle comprises a carbon fiber tow having from 1 thousand to 50 thousand generally cylindrical carbon fibers each having a diameter ranging from 6 to 10 microns.

4. A heating element assembly as set forth in claim 1 wherein said bundle comprises a carbon fiber tow having 50 thousand generally cylindrical fibers each having a 7 micron diameter.

5. A heating element assembly as set forth in claim 1 wherein said sheath comprises a thermoplastic material.

6. A heating element assembly as set forth in claim 5 wherein said thermoplastic material comprises a polyester.

7. A healing element assembly as set forth in claim 6 wherein said polyester comprises MYLAR.

8. A heating element assembly as set forth in claim 1 where said sheath comprises a thermosetting material.

9. A heating element assembly as set forth in claim 1 wherein said thermosetting material comprises a polyimide.

10. A heating element assembly as set forth in claim 9 wherein said polyimide comprises KAPTON.

11. A heating element assembly as set forth in claim 1 wherein said upper and lower layers are formed by separate webs of dielectric sheet material arranged in face-to-face relation to each other with said bundle therebetween and said layers have marginal portions extending outwardly in opposite transverse directions beyond longitudinally extending side edges of said bundle and bonded together and sealed in face-to-face relation to each other.

12. A heating element assembly as set forth in claim 11 wherein said upper face of said lower layer is bonded to said lower surface of said bundle and said marginal portions are bonded in face-to-face relation to each other by pressure sensitive adhesive.

13. A heating element assembly as set forth in claim 11 wherein said upper face of said lower layer is bonded to said lower surface of said bundle and said marginal portions are bonded in face-to-face relation to each other by heat activated adhesive.

14. A heating element assembly as set forth in claim 11 wherein said marginal portions are bonded together by ultrasonic welds.

15. A heating element assembly as set forth in claim 11 wherein said webs are of equal transverse width.

16. A heating element assembly as set forth in claim 11 wherein said webs are of unequal transverse width.

17. A heating element assembly as set forth in claim 1 including coding means for visually distinguishing said bonded lower layer from said unconnected upper layer.

18. A heating element assembly as set forth in claim 17 wherein said coding means comprises a color code.

19. A heating element assembly as set forth in claim 1 wherein said bundle has a terminal end portion projecting axially outwardly beyond an associated end of said upper layer and said lower layer has a bundle stabilizing tab projecting axially outwardly beyond said associated end in underlying relation and bonded to said terminal end portion.

20. A heating element assembly as set forth in claim 1 wherein the thickness of said lower layer is greater than the thickness of said upper layer.

21. A heating element assembly as set forth in claim 1 wherein said bundle has an electrical resistance in the range of 0.1 to 3.0 ohms/linear foot.

22. A heating element assembly as set forth in claim 1 wherein said bundle has an electrical resistance in the range of 2 to 3 ohms per linear foot.

23. A heating element assembly as set forth in claim 1 wherein said bundle has a thickness to width ratio of approximately one to twenty-five.

24. A heating element assembly as set forth in claim 1 wherein said bundle and said dielectric sheath are flexible.

25. A heating element assembly as set forth in claim 1 wherein said upper and lower layers have substantially the same thickness.

26. A heating element assembly comprising; an axially elongated flexible carbon fiber tow having a generally flat configuration and including from 1 thousand to 50 thousand axially elongated generally cylindrical continuous rectilinear axially extending carbon filaments having a diameter from 6 to 20 microns and arranged in immediately adjacent parallel relation to each other, said tow having an electrical resistance of 2 to 3 ohms per linear foot, and an outer jacket of polyester sheet material including two layers of said sheet material arranged in facing relation to each other with said tow disposed therebetween, one of said two layers being a substantially flat planar layer, one of said two layers having a thickness greater than the thickness of the other of said two layers, said tow adhered to one of said two layers, one of said two layers overlying said tow in direct contacting engagement and unconnected relation to said tow.

27. A heating element assembly comprising; a series of axially elongated axially parallel flexible carbon fiber tows of undetermined axial length each spaced from another and having interstacies therebetween, each of said tows including a multiplicity of continuous generally rectilinear axially parallel carbon filaments disposed in immediately adjacent relation to each other and having a predetermined electrical resistance per unit of tow axial length, and an outer insulating jacket of dielectric sheet material including a substantially flat planar first layer and a second layer, said tows adhered to said first layer, said second layer overlying said tows in direct contacting engagement with and unconnected relation to said tows and adhered in sealing relation to said first layer along said interstacies and along marginal portions of said outer insulating jacket immediately outboard of the outermost tows in said series.

28. A method of making a heating element assembly comprising the steps of; continuously advancing an axially elongated first web of dielectric sheet material in an axial direction, simultaneously continuously advancing an axially elongate carbon fiber tow in said axial direction, moisturizing the tow, guiding the tow into axial alignment and overlying adhering engagement with the advancing first web, adhering the tow to the advancing first web, continuously advancing a second web of dielectric sheet material into overlying relation with marginal portions of the first web and the tow adhered to the first web, and joining only axially extending marginal portions of the first and second webs in face-to-face sealing engagement with each other to form an outer sheath containing the tow and embracing the tow along its axial length.

29. A heating element assembly as set forth in claim 26 wherein one of said two layers is wider than the other of said two layers.

30. A heating element assembly as set forth in claim 26 wherein said tow has an electrical resistance of 2 to 3 ohms per linear foot.

31. A heating element assembly as set forth in claim 26 wherein said carbon filaments have a diameter of substantially 7 microns.

32. A heating element assembly as set forth in claim 26 wherein said polyester sheet material comprises KAPTON.

33. A heating element assembly as set forth in claim 26 wherein said tow has a terminal end portion projecting axially outwardly from said outer jacket and one of said two layers has a tow stabilizing tab having a width substantially equal to the width of said tow and projecting axially outwardly from said outer jacket in underlying relation to said terminal end portion and bonded to said terminal end portion.

34. A heating element as set forth in claim 33 wherein said tow and said outer jacket are flexible.

35. A heating element assembly comprising; a flexible generally flat carbon fiber tow having a multiplicity of continuous generally rectilinear parallel carbon fibers extending in an axial direction, said tow having substantially flat upper and lower surfaces parallel to each other and a predetermined electrical resistance per unit of axial length, and an axially elongated outer jacket of dielectric sheet material including two layers of said sheet material arranged in face-to-face relation to each other with said tow disposed therebetween, said two layers having marginal portions projecting outwardly in axially transverse directions from opposite sides of said tow, said marginal portions being bounded together and sealed in face-to-face relation to each other and extending in axial directions along said opposite sides of said tow, one of said two layers being bonded to one of said surfaces comprising said upper surface and said lower surface, one of said two layers being disposed in overlying direct contacting engagement and unconnected relation to one of said surfaces comprising said upper surface and said lower surface.

36. A heating element assembly as set forth in claim 35 wherein one of said two layers is a substantially flat planar layer.

* * * * *

UNITED STATES PATENT AND TRADEMARK OFFICE

CERTIFICATE OF CORRECTION

PATENT NO. : 7,247,822 B2
APPLICATION NO. : 10/772641
DATED : July 24, 2007
INVENTOR(S) : James J. Johnston It is certified that error appears in the above-identified patent and that said Letters Patent is hereby corrected as shown below:

Column 10, line 4, cancel the text beginning with "28. A method of making" to and ending "along its axial length." in column 10, line 18.

"28. A method of making a heating element assembly comprising the steps of; continuously advancing an axially elongated first web of dielectric sheet material in an axial direction, simultaneously continuously advancing an axially elongate carbon fiber tow in said axial direction, moisturizing the tow, guiding the tow into axial alignment and overlying adhering engagement with the advancing first web, adhering the tow to the advancing first web, continuously advancing a second web of dielectric sheet material into overlying relation with marginal portions of the first web and the two adhered to the first web, and jointing only axially extending marginal portions of the first and second webs in face-to-face sealing engagement with each other to form an outer sheath containing the tow and embracing the tow along its axial length."

Signed and Sealed this

Twentieth Day of November, 2007

JON W. DUDAS
*Director of the United States Patent and Trademark Office*